US005077979A

United States Patent [19]

Skertic et al.

[11] Patent Number: 5,077,979

[45] Date of Patent: Jan. 7, 1992

[54] TWO-STAGE JOULE-THOMSON CRYOSTAT WITH GAS SUPPLY MANAGEMENT SYSTEM, AND USES THEREOF

[75] Inventors: Matthew M. Skertic, Chatsworth; Joseph L. Hlava, Woodland Hills, both of Calif.

[73] Assignee: Hughes Aircraft Company, Los Angeles, Calif.

[21] Appl. No.: 497,379

[22] Filed: Mar. 22, 1990

[51] Int. Cl.[5] ..... F25B 19/02

[52] U.S. Cl. ..... 62/51.2; 244/3.16; 250/352

[58] Field of Search ..... 62/51.2, 223; 250/352; 244/3.16

[56] References Cited

U.S. PATENT DOCUMENTS

| | | | |
|---|---|---|---|
| 2,991,633 | 7/1961 | Simon | 62/51.2 |
| 3,293,877 | 12/1966 | Barnes | 62/223 |
| 3,372,556 | 3/1968 | Waldman | 62/51.2 |
| 3,401,533 | 9/1968 | Maybury | 62/51.2 |
| 3,415,078 | 12/1968 | Liston | 62/51.2 |
| 4,126,017 | 11/1978 | Bytniewski et al. | 62/51.2 |

FOREIGN PATENT DOCUMENTS

| | | | |
|---|---|---|---|
| 120131 | 10/1984 | European Pat. Off. | 62/51.2 |
| 2114538 | 3/1971 | Fed. Rep. of Germany | 62/51.2 |

*Primary Examiner*—Ronald C. Capossela
*Attorney, Agent, or Firm*—C. D. Brown; R. M. Heald; W. K. Denson-Low

[57] ABSTRACT

A two-stage Joule-Thomson cryostat (10) has a first-stage cryostat (12) with a helical-coil heat exchanger (14) and and isenthalpic gas expansion orifice (20) that discharges a mixture of cooled gas and cryogenic liquid into a liquid cryogen plenum (26). A second-stage cryostat (30) with a helical coil heat exchanger (32), wound to a larger diameter than the first-stage heat exchanger coil (14), is wound around and in thermal contact with the liquid cryogen plenum (26). This arrangement achieves a high degree of interstage heat transfer and cooling of the gas flowing in the second-stage heat exchanger coil (32) by the liquid cryogen in the first-stage liquid cryogen plenum (26). In operation, a gas flow management system (60), designed for rapid cool-down, initially passes a first gas of high specific refrigerating capacity through both stages (12 and 30). When the stages and structure are sufficiently cooled to the near-vicinity of the normal boiling temperature of the first gas, the flow of the first gas through the second-stage cryostat (30) is discontinued, and flow of a second gas of lower normal boiling temperature than the first gas is passed through the second stage cryostat (30). The flow of the first gas continues through the first-stage cryostate (30).

28 Claims, 4 Drawing Sheets

TWO-STAGE JOULE-THOMSON CRYOSTAT WITH GAS SUPPLY MANAGEMENT SYSTEM, AND USES THEREOF

BACKGROUND OF THE INVENTION

This invention relates to a cryostat in which cooling is achieved by the isenthalpic expansion of a high-pressure gas through a Joule-Thomson orifice, and, more particularly, to a two-stage cryostat having a gas flow management system for achieving rapid cooldown.

Many types of devices, such as infrared detectors, are operated at very low temperatures, as for example 100K or less. In some cases, low temperature operation is required because physical or chemical processes of interest occur only at low temperature or are more pronounced at low temperature, and in other cases because some types of electrical-thermal noise are reduced at low temperature. An approach to cool the device to low temperature is therefore required.

The simplest and most direct approach to cooling a device to a low operating temperature is to bring the device into thermal contact with a bath of liquid gas whose normal boiling temperature is approximately the desired operating temperature. This liquid contacting bath ensures that the temperature of the device will not exceed the boiling temperature of the liquefied gas.

While the liquid contacting bath approach is preferred for laboratory and other stationary cooling requirements, the cooling of small devices in mobile applications, or other situations that make the use of stored liquid coolants difficult, requires another approach. For example, it may not be possible to provide liquefied gas to a device operated in a remote site, or in space. Also, it may be inconvenient or impossible to store liquefied gases for long periods of time, or periodically service the store of liquefied gas.

Various approaches have been developed to cool devices to a low operating temperature, without using stored liquefied gas as a contacting bath coolant. For example, gas expansion coolers expand compressed gas through a Joule-Thomson orifice, thereby cooling and partially liquefying the gas and resulting in absorption of heat from the device to be cooled, the cooling load. Several types of thermoelectric devices and closed cycle mechanical gas refrigerators can also be used.

The various cooling approaches that do not require a stored liquefied gas are operable and useful in a range of situations. However, they all have the shortcoming that they cannot achieve very rapid cooling of the cooling loads demanded by many systems. The fastest cooldown times are achievable with a Joule-Thomson gas expansion cryostat, which is known to have the capability of cooling very small thermal load masses with removable enthalpy values of tens of Joules to approximately 120 K. within a few seconds. However, when the thermal mass load is significantly larger and when lower cold temperature is required, the conventional Joule-Thomson cryostat is inadequate. For example, a conventional Joule-Thomson gas expansion cryostat may require 30 seconds and typically more than a minute to cool a device from ambient temperature to a temperature of 80 K., removing about 250 Joules in the cooling process. This cooling rate is simply too slow for some mobile applications, where cooling times of 5–20 seconds may be required. Thus, although many cooling devices that do not require stored liquefied gas can cool to low temperature, available systems achieve this cooling rather slowly.

Additionally, some specialized devices and cooling systems have unique packaging and space requirements. For example, an infrared heat seeking detector in the nose of a missile must be securely supported and rapidly cooled upon demand, but the overall size and weight of the cooling system is severely limited by the overall system constraints.

There is a need for a cooling apparatus that does not require stored liquefied gas, and that achieves very rapid cooling of large thermal mass loads to temperatures of 80 K. or less. The size and weight of the cooling apparatus, including the hardware and any stored consumables that may be required, must be as small as possible. The present invention fulfills this need, and further provides related advantages.

SUMMARY OF THE INVENTION

The present invention provides a cooling apparatus that does not require stored liquefied gas, and that achieves rapid cooling of conventional devices, from an initial ambient temperature to cryogenic temperatures. The apparatus can be constructed in large or small sizes. It utilizes stored pressurized gases to provide the cooling, and can be operated with a temperature-based feedback control. The cooling apparatus is particularly useful in missile systems wherein the missile has an infrared sensor requiring rapid cooldown at the beginning of operation, and maintenance of the cooled state during operation.

In accordance with the invention, a cooling apparatus comprises a two-stage cryostat having a first-stage cryostat with a first heat exchanger coil and a first gas expansion orifice, and a second-stage cryostat with a second heat exchanger coil and a second gas expansion orifice; and a gas supply management system for supplying pressurized gas to the cryostat, the gas supply system including a first supply source of a first pressurized gas, a first gas supply line from the first supply source to the first-stage cryostat, a first gas supply valve in the first gas supply line, a second supply source of a second pressurized gas, a second gas supply line from the second supply source to the second-stage cryostat, a second gas supply valve in the second gas supply line, and means for controllably permitting the first pressurized gas to flow from the first supply source to the second-stage cryostat.

The two-stage cryostat comprises a first-stage cryostat having a first-stage heat exchanger coil of tubing, a first-stage Joule-Thomson orifice at a cold end of the first stage heat exchanger coil of tubing, and a liquid cryogen plenum at the cold end of the heat exchanger coil in which cooled and liquefied gas expanded through the orifice is received; and a second-stage cryostat having a thermally conducting second-stage support mandrel with an inner dimension greater than the outer dimension of the first-stage heat exchanger coil of tubing and overlying the first-stage heat exchanger coil of tubing, a second-stage heat exchanger coil of tubing wound upon the second-stage support mandrel, the second-stage heat exchanger coil of tubing extending beyond the liquid cryogen plenum and including a plurality of intercooler turns wound onto, and in thermal communication with, the liquid cryogen plenum, and a second-stage Joule-Thomson orifice at a cold end of the first-stage heat exchanger coil of tubing. Preferably, the first-stage and second-stage heat exchanger coils are wound to a helical configuration, the first-stage coil within the second-stage coil.

The two-stage cryostat and the gas supply system are particularly useful in achieving rapid cooling of a thermal cooling load, starting from ambient temperature and reaching cryogenic temperatures in a matter of seconds. In one mode of operation, the first gas having a high specific refrigerating capacity but also a relatively high normal boiling temperature, such as argon or Freon 14, is flowed through the first-stage and second-stage cryostats at the initiation of the refrigerating process. The expansion of this gas through the Joule-Thomson orifices of the two stages, and the countercurrent flow of the cooled gas around the respective heat exchanger coils, cools the apparatus itself and the cooling load to an intermediate low temperature that is preferably at or near the boiling temperature of the first gas.

After an intermediate low temperature is reached, the flow of the first gas through the second-stage cryostat is discontinued by one of several means, such as, for example, one which allows a fixed period of time to elapse or one which senses the cold temperature and triggers a valving action in the gas management system. At the same time, a flow of the second gas through the second-stage cryostat is initiated. The second gas is of lower specific refrigerating capacity but also lower normal boiling temperature than the first gas, such as nitrogen or a nitrogen-neon mixture. The flow of the first gas through the first-stage cryostat is continued.

The flow of the first gas through the first-stage cryostat continues to remove heat from the thermal cooling load, and to produce liquefied gas in the cryogen plenum. The intercooler turns of the second-stage helical coil wound directly onto the plenum provide an important increment of cooling to the second gas flowing in the second-stage cryostat prior to passing through the expansion orifice. This increment of cooling permits a large fraction of the second gas to reach a sufficiently low temperature before passing through the orifice that liquefaction occurs, in a short time after the gas flows are initiated. The switching from the flow of the first gas through the second-stage cryostat to the flow of the second gas through the second-stage cryostat is optimized for the particular thermal cooling load.

The present invention provides an important advance in the art of rapidly cooling, gas expansion cryogenic coolers. In one particular application, a cooling load can be cooled from ambient temperature to below 80 K. in less than 10 seconds. The best competitive approach requires over 30 seconds, and typically several minutes, to cool the cooling load to that temperature. Other features and advantage so the invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
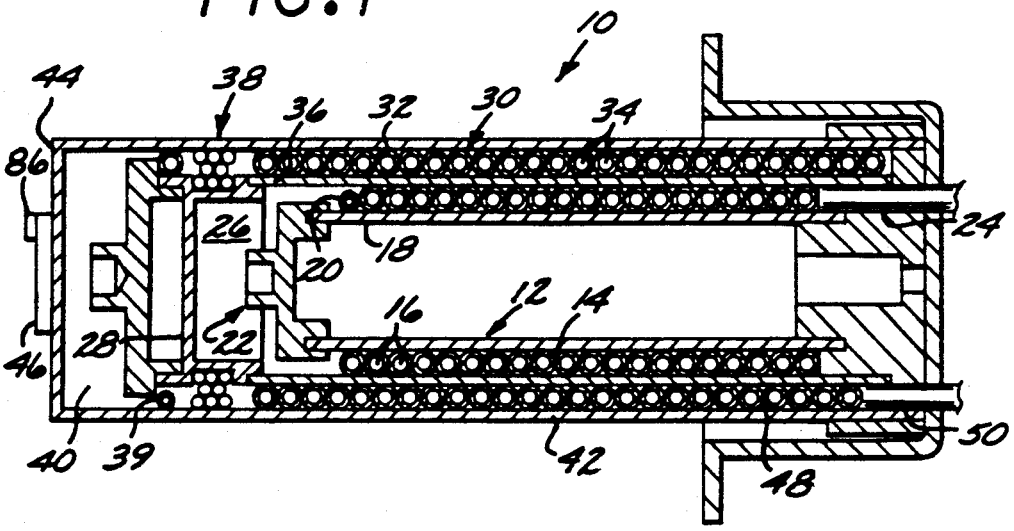
FIG. 1 is a side sectional view of a two-stage cryostat of the invention.

The preferred apparatus of the invention includes a two-stage cryostat and a gas supply system that provides two gases to the cryostat. A two stage cryostat 10 is illustrated in FIG. 1. A first-stage cryostat 12 portion of the two-stage cryostat 10 includes a first-stage helical heat exchanger coil 14 of tubing 16. The helical coil 14 is wound as a plurality of turns of the tubing 16 onto a first-stage mandrel 18. The tubing 16 is preferably made as a hollow pressure tube having fins on the outside thereof to improve heat transfer out of the contents of the tubing 16.

A first-stage Joule-Thomson orifice 20 of reduced diameter is formed at a cold end 22 of the first-stage helical heat exchanger coil 14, remote from the end where gas is introduced into the first-stage helical coil 14 through an external connector 24. In the preferred approach, the first-stage orifice 20 is a length of tubing having an outside diameter slightly smaller than the inside diameter of the tubing 16 of the first-stage helical coil 14, and is forced into the end of the tubing 16 and brazed in place. A pressurized gas is introduced into the helical coil 14 through the connector 24, flows the length of the helical coil 14, and expands through the orifice 20. Expansion of the pressurized gas causes it to cool, and partially liquefy.

A liquid cryogen plenum 26 is present as the interior of a cup 28 made of a metallic conducting material at the cold end 22 of the first-stage cryostat 12. Any liquefied gas produced by the expansion of the gas from the first-stage orifice 20 is collected in the liquid cryogen 26. As the liquefied gas in the liquid cryogen plenum 26 absorbs heat from the surroundings in the manner to be described subsequently, it vaporizes. The vaporized gas flows in the counterflow direction past the turns of the finned tubing 16 of the first-stage helical coil 14, precooling the gas in the helical coil 14 before it reaches the first-stage orifice 20.

A second-stage cryostat 30 includes a second-stage helical heat exchanger coil 32 that is formed by winding a plurality of turns of tubing 34 onto a hollow cylindrical second stage support mandrel 36. The mandrel 36 is formed of a thin thermally conducting material, with an inside diameter just larger than the outside diameter of the first-stage helical coil 14, so that it slips over the first-stage helical coil 14. As illustrated, the overall length of the second-stage helical coil 32 is greater than the length of the first-stage helical coil 14.

In the preferred approach, the tubing 34 that forms the second-stage helical coil 32 is finned over the portion of its length that is oppositely disposed to the tubing 16 of the first-stage helical coil 14. An intercooler portion 38 of the length of the tubing 34 is wound over, and soldered onto, the exterior of the liquid cryogen plenum 26, and is not finned to permit closer packing of the turns of the intercooler portion 38. The close packing and soldering produces good thermal communication between the intercooler 38 and the liquid cryogen plenum 26.

Preferably, as illustrated, the intercooler portion 38 is wound as several overlapping layers, again to increase the heat transfer from the intercooler portion 38 and the gas flowing through the second-stage helical coil 32, into the liquefied gas within the liquid cryogen plenum 26. This increment of cooling of the gas flowing within the second-stage helical coil 32 further increases the proportion of the gas which is liquefied when it expands from the second-stage helical coil 32 through a second-stage Joule-Thomson orifice 39 located at a cold end 40 of the second-stage helical coil 32.

A cylindrical outer wall 42 has an inner diameter that is just slightly larger than the outer cylindrical diameter of the second-stage helical coil 32. The outer wall 42 is made of a material having a low thermal conductivity that insulates the cryostat 10. An end plate 44 made of a material having a high thermal conductivity closes the cold end of the outer wall 42. A thermal cooling load 46 is preferably mounted on the outside of the end plate 44 in thermal contact with the cryostat 10 and particularly with the second-stage cryostat 30, so that it is conductively cooled by the liquid and cold gaseous cryogen formed by the expansion of gas through the second-stage orifice 39 in the interior of the cryostat 10. The thermal cooling load 46 may be anything that requires rapid cooldown, and in a preferred embodiment is a sensor such as an infrared sensor. As the liquefied gas formed from the expansion of gas out of the second-stage orifice 39 cools the thermal cooling load 46, it is vaporized to form a cold gas. The outer wall 42 and the first-stage mandrel 18 cooperate to form a gas flow channel 48 therebetween, so that the cold gas must flow from the cold end 40 toward the warmer end of the cryostat 10 in a counterflow pattern relative to the second-stage helical heat exchanger coil 32.

Thus, ambient temperature gas is introduced into the second-stage helical coil 32 at a connector 50 remote from the cold end 40, and flows the length of the helical coil 32. During its passage down the length of the second-stage helical coil 32, it is rapidly cooled by three separate heat-removal mechanisms. Heat is removed by conduction through the conductive second-stage mandrel 36 to the first-stage cryostat 12, and also by the counterflow of cold gas flowing in the gas flow channel 48. Heat is further removed in the intercooler portion 38 to the liquefied gas in the liquid cryogen plenum 26. These three heat-removal paths rapidly cool the gas flowing in the second-stage helical coil 32, thereby resulting in rapid cooling of the thermal cooling load 46.

A further contribution to the rapid cooling capability of the cryostat 10 is the selection and sequencing of the gases used in the cryostats 12 and 30. In accordance with this aspect of the invention, a process for rapidly cooling a thermal cooling load to an operating temperature comprises the steps of furnishing a two-stage cryostat having a first-stage cryostat and a second-stage cryostat; passing a first gas through the first-stage cryostat and the second-stage cryostat to cool the thermal cooling load to an intermediate temperature less than the ambient temperature but greater than the operating temperature; discontinuing the flow of the first gas through the second-stage cryostat but continuing the flow of the first gas through the first-stage cryostat; and passing a second gas through the second-stage cryostat, after the flow of the first gas through the second-stage cryostat is discontinued, the first gas having a specific refrigerating capacity greater than the second gas, but the second gas having a normal boiling temperature less than the first gas.

The specific refrigerating capacity of a gas used in a Joule-Thomson cryostat is equal to the difference in specific gas enthalpy, which may be expressed in Watts per standard liter per minute (W/SLPM), of the cooling gas leaving the cryostat and the cooling gas entering the cryostat. The gas normally enters the cryostat at high pressure, typically several thousand pounds per square inch, and at ambient temperature, typically 295 K., and leaves the cryostat at low exit pressure, typically one atmosphere and at a temperature a few degrees colder than ambient temperature. The specific refrigeration of argon gas, for example, is optimized at 8000 pounds per square inch (psi), with a value of 1.37 W/SLPM. The specific refrigeration of Freon-14 is much higher, with a value of 6.2 W/SLPM at an input pressure of 4000 psi. Argon and Freon-14 have relatively high normal boiling temperatures (NBT) of 87.3 K. and 145.2 K., respectively. Nitrogen, with a lower NBT of 77.4 K. has an ideal specific refrigeration of only 0.78 W/SLPM at 6000 psi input pressure. Mixtures of nitrogen and neon gases produce lower boiling temperatures, typically 68–73 K. with only about 0.4 W/SLPM refrigeration capacity. Thus, for most cases, the lower the normal boiling temperature of a gas or gas mixture, the lower the specific refrigeration. More importantly, the greater the specific refrigeration of a gas, the greater the rate at which it can absorb heat from its surroundings, and the faster it can achieve cooling of the thermal load.

In a fast cooling cryostat system such as required for the preferred applications of the present invention, it is desirable to use a gas having a high specific refrigerating capacity to cool the thermal cooling load. However, the higher the specific refrigerating capacity, the higher the normal boiling point of the gas. Thus, if it is necessary to cool a cooling load to a low temperature, there is conflict between the desire to use a gas with a high specific refrigerating capacity and a gas with a low normal boiling temperature that is required so that the cryostat can achieve low temperatures.

In the presently preferred approach, a first gas with a high specific refrigerating capacity, such as argon or Freon-14, is initially flowed through both the first-stage cryostat 12 and the second-stage cryostat 30. This achieves a rapid initial cooling of the cryostat 10 from ambient temperature to some intermediate temperature that is less than ambient temperature but greater than the actual operating temperature to which the thermal cooling load 46 is to be cooled.

The flow of the first gas is thereafter continued through the first-stage cryostat 12, because the first gas permits a rapid extraction of heat to the intermediate temperature during continued operation of the cryostat 10. At the intermediate temperature, however, the flow of the first gas through the second-stage cryostat 30 is discontinued, because the required operating temperature cannot be achieved using the first gas because its normal boiling temperature is too high.

Instead, a second gas is thereafter flowed through the second-stage cryostat 30, to provide a capability for cooling to the operating temperature. The second gas is preferably nitrogen or a mixture of nitrogen and neon, to achieve operating temperatures below about 80 K. If the second gas had been flowed through the second-stage cryostat from the beginning of the cooling cycle, the cooldown would have been slower than that achieved through the use of the two gases in the manner described.

Figure 2:
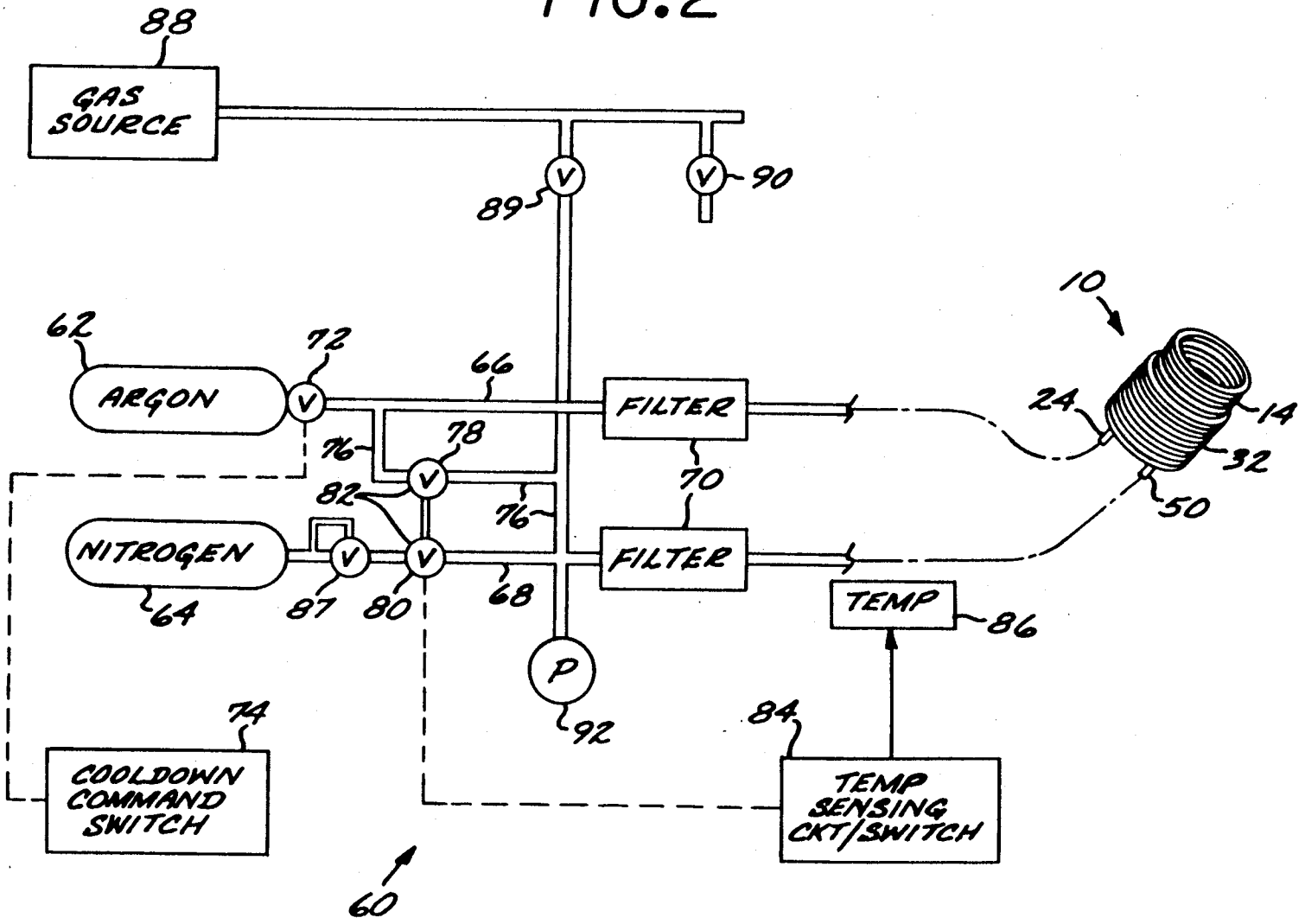
FIG. 2 is a schematic view of one embodiment of gas supply system.

A schematic drawing of a gas supply management system 60 is illustrated in FIG. 2, in relation to the first-stage cryostat 12 and the second-stage cryostat 30 of the two-stage cryostat 10. The first and second gases are contained in a first gas supply source 62 and a second gas supply source 64, respectively, which are each preferably high-pressure gas bottles. A first gas supply line 66 extends from the first gas supply source 62 to the connector 24 of the first-stage helical heat exchanger coil 14. A second gas supply line 68 extends from the second gas supply source 64 to the connector 50 of the second-stage helical heat exchanger coil 32. Preferably, a solid element gas filter 70 is provided in each of the supply lines 66 and 68, such as a 5 micrometer solid particle filter.

A first gas supply valve 72, which is normally closed, is placed in the first gas supply line 66 between the source 62 and the connector 24. The valve 72 is preferably a pyrotechnic one-time opening valve that is opened by the firing of an explosive charge within the valve upon command of a cooldown command switch 74 to initiate the cooldown sequence from ambient temperature.

The first gas supply line 66 communicates with the second gas supply line 68 through an interconnect line 76. A normally open interconnect valve 78 is placed in the line 66. When the first gas supply valve 72 is activated and opened by the cooldown command switch 74, a flow of first gas from the first gas supply source 62 immediately flows into the first-stage helical heat exchanger coil 14 and also into the second-stage helical heat exchanger coil 32.

The second gas supply line 68 has a second gas supply valve 80 between the second gas supply source 64 and the point at which the interconnect line 76 communicates with the second gas supply line 68. The second gas supply valve 80 is normally closed, thereby preventing gas flow from the second gas supply source 64 during storage, and preventing any flow of the first gas into the second gas supply source 64 after the first gas supply valve 72 has been opened.

The second gas supply valve 80 and the interconnect valve 78 are preferably provided as a single double acting valve 82. When the valve 82 is activated, the normally open interconnect valve 78 is closed, and, simultaneously, the normally closed second gas supply valve 80 is opened. This operation discontinues the flow of the first gas to the second-stage helical heat exchanger coil 32, and simultaneously initiates the flow of the second gas to the second-stage helical heat exchanger coil 32.

Operation of the double acting valve 82 is initiated by a temperature sensing switch 84, which in turn receives a temperature signal from a sensor 86 mounted on the thermal cooling load 46. Thus, when the thermal cooling load 46 has been cooled to a preselected intermediate temperature, the double acting valve 82 is automatically operated by the temperature sensing switch 84. The gas flow is thereby changed from the first gas flowing to both cryostats 12 and 30, to the first gas flowing to the first-stage cryostat 12 and the second gas flowing to the second-stage cryostat 30.

A pressure regulator 87 in the second gas supply line 68 between the second gas supply source 64 and the second gas supply valve 80 limits the pressure of the second gas reaching the second-stage cryostat 30 to a preselected value.

Optionally, some auxiliary gas flow capability can be provided. As illustrated in FIG. 2, an external source of a gas 88 connected through a valve 89, a pressure relief valve 90, and a pressure sensor 92 can be provided to expand the usefulness of the gas supply system.

The gas supply system 60 has the important advantage that it requires only an initiation of operation by the cooldown command switch 74, and that thereafter the sequencing of the gas flows is entirely automatic. When the cooling load 46 reaches its preselected intermediate temperature, the switchover to the second gas flowing to the second-stage cryostat 30 is fully automatic. This automatic sequencing operation is desirable where the cooldown system is to be stored for a period of time prior to use.

Figure 3:
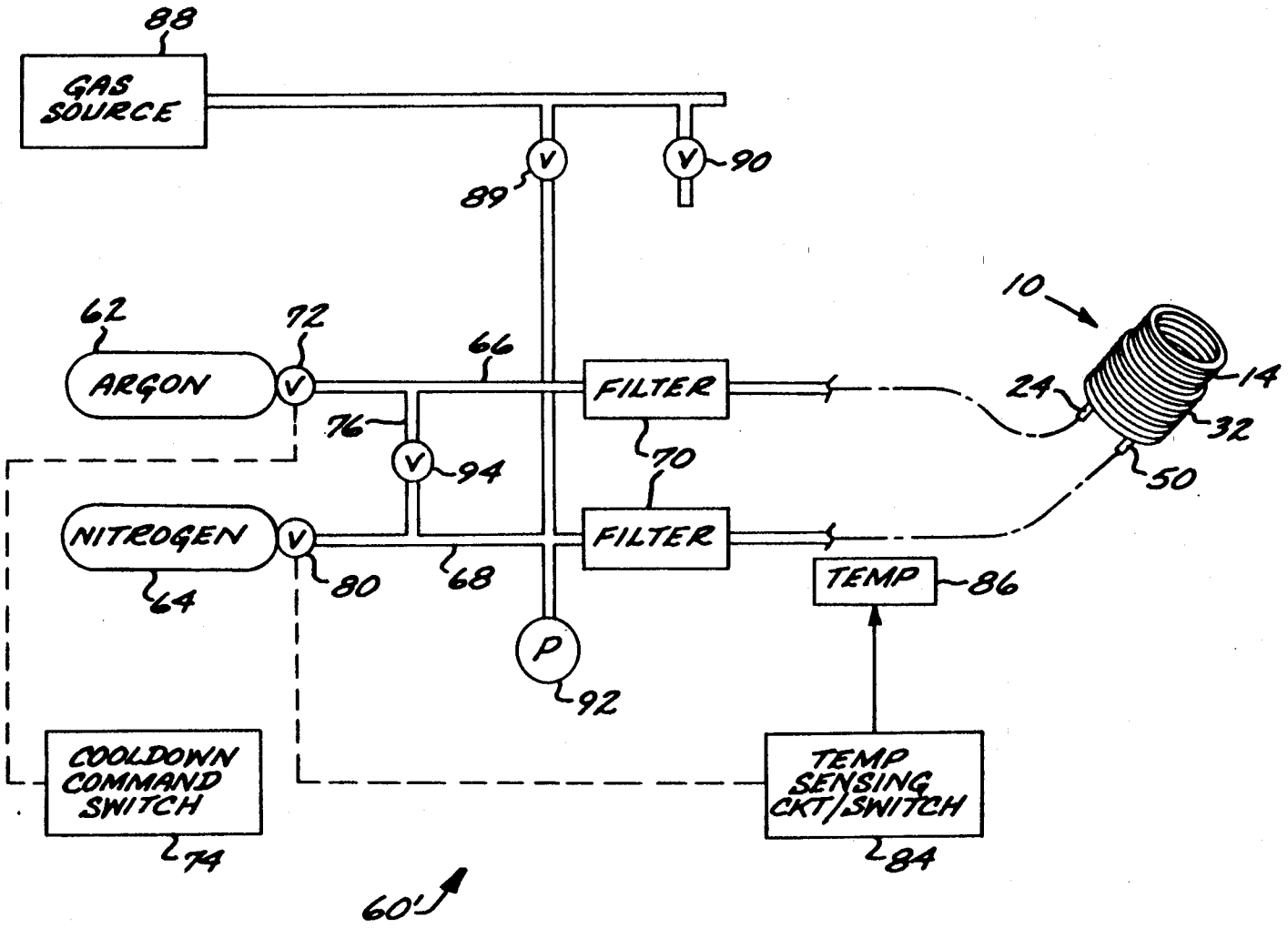
FIG. 3 is a schematic view of a second embodiment of gas supply system.

FIG. 3 illustrates an alternative gas supply system 60'. Most of the components are identical to the system 60 of FIG. 2, and are identified with corresponding numerals. The exception is that the double acting valve 82 is replaced by a check valve 94. When the second gas supply valve 80 is opened by the command of the temperature sensing switch 84, the gas pressure of the second gas in the second gas supply line 68 is sufficiently great that the first gas does not flow through the interconnect line 76 and the check valve 94 is closed to prevent flow of the second gas through the interconnect line 76 and into the first gas supply line 66. This structure has the advantage of increased simplicity over the gas supply system of FIG. 2.

A cooldown system was constructed to demostrate the operation of the invention. The first-stage helical heat exchanger coil 14 was formed of 18 turns of copper-nickel alloy tubing of inside diameter 0.012 inches and outside diameter 0.020 inches, with copper fins soldered thereto, and having a cylindrical outer diameter of 0.040 inches. The first-stage orifice 20 was a piece of tubing of 0.010 inch outside diameter and 0.005 inch inside diameter soldered into the end of the copper-nickel alloy tubing. The second-stage helical heat exchanger coil 32 was formed of 22 turns of copper-nickel alloy tubing having the same form and dimensions as the tubing used in the first-stage helical heat exchanger coil, except that the intercooler portion 38 was unfinned and formed as three layers wound and soldered onto the liquid cryogen plenum 26. The overall length of the cryostat, including end fittings, was about 1.13 inches and the outside diameter was about 0.37 inches. The thermal cooling load 46 attached to the end of the cryostat 10 is of a mass such that about 120 Joules of heat energy must be removed from the thermal cooling load to cool it from ambient temperature to less than about 80 K.

Figure 4:
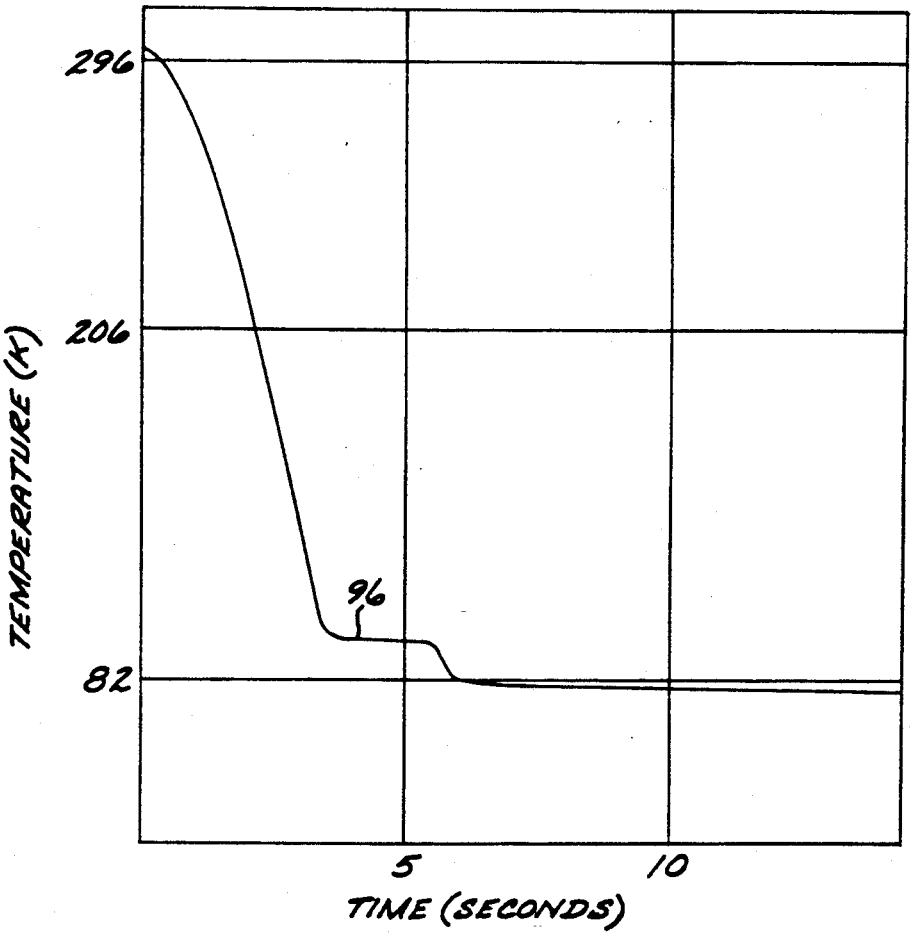
FIG. 4 is a graph of temperature versus time for the cooling load during operation of the two-stage cryostat under one set of operating conditions.

FIG. 4 is a graph of the measured temperature of the thermal cooling load as a function of time after the initiation of the flow of the first gas by operation of the cooldown command switch 74. In the test illustrated, the first gas was argon at an initial pressure of 8000 pounds per square inch, the second gas was a mixture of 15 percent by volume neon and 85 percent by volume nitrogen at an initial pressure of 4500 psi, and the volume of each of the gas bottles forming the sources 62 and 64 was 7.5 cubic inches.

As seen in FIG. 4, the cooling load reached a temperature of about 90 K. in about 3–4 seconds, but the temperature is not thereafter reduced further. However, at that point the temperature sensing switch 84 is activated (at point 96) by reaching that preselected intermediate temperature. The temperature of the cooling load begins to decrease again within about 1 second, and a temperature less than about 80 K. is reached after a total cooling time of about 6 seconds. The cooling time could be shortened even further by selecting the intermediate temperature at a slightly higher value, to shorten the temperature plateau at about 90 K. In the test illustrated in FIG. 4, the plateau was left in the lengthened form to illustrate the various stages in the operation of the cool-down system.

By comparison, existing conventional non-immersion cooldown systems require more than 30 seconds, and as high as 150 seconds, to achieve similar cooling of the cooling load.

Figure 5:
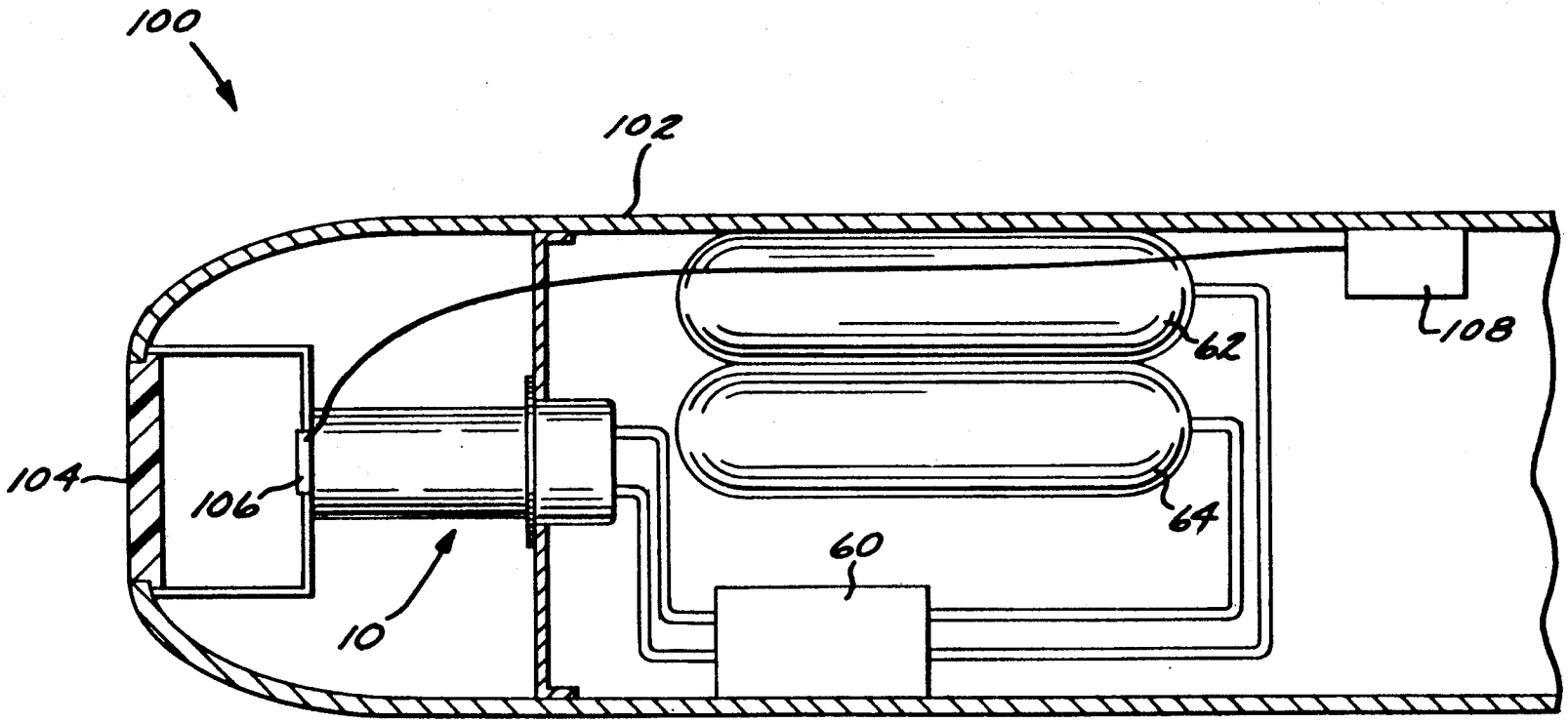
FIG. 5 is a schematic view of a missile system utilizing the two-stage cryostat of the invention.

A preferred application of the invention is illustrated in FIG. 5. A missile 100 has a body 102 with a transparent window 104 in the nose thereof. Mounted behind the window 104 is the two-stage cryostat 10 with its cooling load 46, in this case an infrared sensor 106, supported on the forward-facing end of the cryostat 10 in the manner illustrated in greater detail in FIG. 1. The electrical output signal of the sensor 106 is conducted to a control system 108 of the missile 100. The control system 108 provides guidance control signals to the control surfaces of the missile 100, which are not shown in the drawing. The gas supply system 60, which preferably is of the type illustrated in FIG. 2 or 3, receives pressurized gas from the supply sources 62 and 64, and provides a controlled gas flow to the two-stage cryostat 10.

During the launch sequence of the missile 100, the gas supply system 60 operates in the manner described previously to cool the cryostat 10 and the infrared sensor 106 to the proper operating temperature of the sensor. The sensor then searches for the heat produced by the target of the missile and provides the target signal to the control system 108 so that the missile is guided to the target.

Although particular embodiments of the invention have been described in detail for purposes of illustration, various modifications may be made without departing from the spirit and scope of the invention. Accordingly, the invention is not to be limited except as by the appended claims.

What is claimed is:

1. A cooling apparatus, comprising:

a first-stage cryostat having a first-stage heat exchanger coil of tubing, a first-stage Joule-Thomson orifice at a cold end of the first stage heat exchanger coil of tubing, and a liquid cryogen plenum at the cold end of the heat exchanger coil in which cooled and liquefied gas expanded through the orifice is received; and a second-stage cryostat having a thermally conducting second-stage support mandrel with an inner dimension greater than the outer dimension of the first-stage heat exchanger coil of tubing and overlying the first-stage heat exchanger coil of tubing, a second-stage heat exchanger coil of tubing wound upon the second-stage support mandrel, the second-stage heat exchanger coil of tubing extending beyond the liquid cryogen plenum and including a plurality of intercooler turns wound onto, and in thermal communication with, the liquid cryogen plenum, and a second-stage Joule-Thomson orifice at a cold end of the first-stage heat exchanger coil of tubing.

2. The apparatus of claim 1, wherein the heat exchanger tubing of the first-stage coil is finned.

3. The apparatus of claim 1, wherein the heat exchanger tubing of the second-stage coil is finned, except for the intercooler portion, which is unfinned.

4. The apparatus of claim 1, wherein the first-stage heat exchanger coil of tubing and the second-stage heat exchanger coil of tubing are each wound into a helical pattern.

5. The apparatus of claim 1, further including means for introducing gases into the first-stage cryostat and into the second-stage cryostat.

6. The apparatus of claim 5, wherein the means for introducing includes means for controlling the flow of gases into the first-stage cryostat and into the second-stage cryostat.

7. The apparatus of claim 1, further including a gas flow system controllable to provide a first gas to the first-stage cryostat and the second-stage cryostat under an initial operating condition, and controllable to provide the first gas to the first-stage cryostat and a second gas to the second-stage cryostat under a final operating condition.

8. The apparatus of claim 7, further including a thermal cooling load having a temperature sensor therein.

9. The apparatus of claim 8, wherein the temperature sensor provides a control signal for controlling the flow of gases.

10. A cooling apparatus, comprising:

a two-stage cryostat having a first-stage cryostat with a first heat exchanger coil and a first gas expansion orifice, and a second-stage cryostat with a second heat exchanger coil and a second gas expansion orifice; and a gas supply management system for supplying pressurized gas to the cryostat, the gas supply system including a first supply source of a first pressurized gas, a first gas supply line from the first supply source to the first-stage cryostat, a first gas supply valve in the first gas supply line, a second supply source of a second pressurized gas, a second gas supply line from the second supply source to the second-stage cryostat, a second gas supply valve in the second gas supply line, and means for controllably permitting the first pressurized gas to flow from the first supply source to the second-stage cryostat when no second gas is flowing from the second gas supply source to the second-stage cryostat, but not permitting the first gas to flow from the first supply source to the second-stage cryostat when the second gas is flowing from the second gas supply source to the second-stage cryostat.

11. The apparatus of claim 10, wherein the means for controllably permitting includes a gas interconnect line from the first gas supply line to the second gas supply line, and a gas interconnect valve in the gas interconnect line.

12. The apparatus of claim 10, wherein the means for controllably permitting includes a normally open gas interconnect valve between the first gas source and the second-stage cryostat which closes when the second gas supply valve is opened.

13. The apparatus of claim 10, wherein the means for controllably permitting includes a check valve that permits gas to flow from the first gas source to the second-stage cryostat but not in the opposite direction.

14. The apparatus of claim 10, wherein the means for controllably permitting includes a temperature sensor that senses the temperature of a cooling load.

15. The apparatus of claim 10, wherein the means for controllably permitting includes a controller.

16. The apparatus of claim 10, wherein the first gas is selected from the group consisting of argon and Freon-14.

17. The apparatus of claim 10, wherein the second gas is selected from the group consisting of nitrogen and a mixture of nitrogen and neon.

18. The apparatus of claim 10, wherein the two-stage cryostat includes a first-stage cryostat having a first-stage helical heat exchanger coil of tubing, a first-stage orifice at a cold end of the first stage helical heat exchanger coil of tubing, and a liquid cryogen plenum at the cold end of the first-stage helical coil in which cooled and liquified gas expanded through the orifice is received; and a second-stage cryostat having a thermally conducting cylindrical second-stage support mandrel with an inner diameter greater than the outer diameter of the first-stage helical heat exchanger coil of tubing and overlying the first-stage helical heat exchanger coil of tubing, a second-stage helical heat exchanger coil of tubing wound upon the cylindrical second-stage support mandrel, the second-stage helical coil of tubing extending beyond the liquid cryogen plenum and including a plurality of intercooler turns wound and soldered onto the liquid cryogen plenum, and a second-stage orifice at a cold end of the first-stage helical heat exchanger coil of tubing.

19. A process for rapidly cooling a thermal cooling load to an operating temperature, comprising the steps of:

furnishing a two-stage cryostat having a first-stage cryostat and a second-stage cryostat;

passing a first gas through the first-stage cryostat and the second-stage cryostat to cool the thermal cooling load to an intermediate temperature less than the ambient temperature but greater than the operating temperature;

discontinuing the flow of the first gas through the second-stage cryostat but continuing the flow of the first gas through the first-stage cryostat; and passing a second gas through the second-stage cryostat, after the flow of the first gas through the second-stage cryostat is discontinued, the first gas having a specific refrigerating capacity greater than the second gas, but the second gas having a normal boiling temperature less than the first gas.

20. The process of claim 19, wherein the first gas is selected from the group consisting of argon and Freon-14.

21. The process of claim 19, wherein the second gas is selected from the group consisting of nitrogen and a mixture of nitrogen and neon.

22. The process of claim 19, wherein the step of discontinuing is performed when the thermal cooling load has been cooled to a preselected temperature.

23. A detector system, comprising:

a two-stage cryostat having a first-stage cyrostat with a first heat exchanger coil and a first gas expansion orifice, and a second-stage cryostat with a second heat exchanger coil and a second gas expansion orifice;

a gas supply management system for supplying pressurized gas to the cryostat, the gas supply system including a first supply source of a first pressurized gas, a first gas supply line from the first supply source to the first-stage cryostat, a first gas supply valve in the first gas supply line, a second supply source of a second pressurized gas, a second gas supply line from the second supply source to the second-stage cryostat, a second gas supply valve in the second gas supply line, and means for controllably permitting the first pressurized gas to flow from the first supply source to the second-stage cryostat when no second gas is flowing from the second gas supply source to the second-stage cryostat, but not permitting the first gas to flow from the first supply source to the second-stage cryostat when the second gas is flowing from the second gas supply source to the second-stage cryostat; and a sensor in thermal contact with the cryostat.

24. A detector system, comprising:

a first-stage cryostat having a first-stage heat exchanger coil of tubing, a first-stage Joule-Thomson orifice at a cold end of the first stage heat exchanger coil of tubing, and a liquid cryogen plenum at the cold end of the heat exchanger coil in which cooled and liquefied gas expanded through the orifice is received;

a second-stage cryostat having a thermally conducting cylindrical second-stage support mandrel with an inner dimension greater than the outer dimension of the first-stage heat exchanger coil of tubing and overlying the first-stage heat exchanger coil of tubing, a second-stage heat exchanger coil of tubing wound upon the second-stage support mandrel, the second-stage heat exchanger coil of tubing extending beyond the liquid cryogen plenum and including a plurality of intercooler turns wound onto, and in thermal communication with, the liquid cryogen plenum, and a second-stage Joule-Thomson orifice at a cold end of the first-stage heat exchanger coil of tubing; and a sensor in thermal contact with the second-stage cryostat.

25. A missile having an infrared detector, comprising:

a missile having a control system that receives an electrical signal from an infrared sensor;

a two-stage cryostat having a first-stage cryostat with a first heat exchanger coil and a first gas expansion orifice, and a second-stage cryostat with a second heat exchanger coil and a second gas expansion orifice;

a gas supply management system for supplying pressurized gas to the cryostat, the gas supply system including a first supply source of a first pressurized gas, a first gas supply line from the first supply source to the first-stage cryostat, a first gas supply valve in first gas supply line, a second supply source of a second pressurized gas, a second gas supply line from the second supply source to the second-stage cryostat, a second gas supply valve in the second gas supply line, and means for controllably permitted the first pressurized gas to flow from the first supply source to the second-stage cryostat when no second gas is flowing from the second gas supply source to the second-stage cryostat, but not permitting the first gas to flow from the first supply source to the second-stage cryostat when the second gas is flowing from the second gas supply source to the second-stage cryostat; and an infrared sensor in thermal contact with the cryostat, the infrared sensor providing an electrical signal to the control system of the missile.

26. A missile having an infrared detector, comprising:

a missile having a control system that receives an electrical signal from an infrared sensor;

a first-stage cryostat having a first-stage heat exchanger coil of tubing, a first-stage Joule-Thomson orifice at a cold end of the first stage heat exchanger coil of tubing, and a liquid cryogen plenum at the cold end of the heat exchanger coil in which cooled and liquefied gas expanded through the orifice is received;

a second-stage cryostat having a thermally conducting cylindrical second-stage support mandrel with an inner dimension greater than the outer dimension of the first-stage heat exchanger coil of tubing and overlying the first-stage heat exchanger coil of tubing, a second-stage heat exchanger coil of tubing wound upon the second-stage support mandrel, the second-stage heat exchanger coil of tubing extending beyond the liquid cryogen plenum and including a plurality of intercooler turns wound onto, and in thermal communication with, the liquid cryogen plenum, and a second-stage Joule-Thomson orifice at a cold end of the first-stage heat exchanger coil of tubing; and an infrared sensor in thermal contact with the second-stage cryostat, the infrared sensor providing an electrical signal to the control system of the missile.

27. A multiple stage cooling apparatus comprising:

a first stage cryostat having a first heat exchanger coil;

a second stage cryostat having a second heat exchanger coil;

means for detecting a specified condition and providing a signal indicative thereof;

a first source of a first gas;

a second source of a second gas; and means, coupled to said means for detecting and providing and coupled to said first and second sources, for providing gas from said first source to said first and second heat exchanger coils prior to receipt of said signal and, upon receipt of said signal, for stopping supply of said first gas to said second heat exchanger coil and providing said second gas from said second source to said second heat exchanger coil.

28. Apparatus according to claim 27 further including a thermal load and wherein said signal indicates that temperature of said thermal load has dropped below a preselected temperature.

* * * * *